United States Patent [19]

Ray

[11] 4,388,551

[45] Jun. 14, 1983

[54] QUICK-HEATING CATHODE STRUCTURE

[75] Inventor: Francis M. Ray, Schaumburg, Ill.

[73] Assignee: Zenith Radio Corporation, Glenview, Ill.

[21] Appl. No.: 209,575

[22] Filed: Nov. 24, 1980

[51] Int. Cl.[3] ..... H01J 1/14; H01J 19/06; H01K 1/04

[52] U.S. Cl. ..... 313/346 R; 313/270; 313/337; 313/341

[58] Field of Search ..... 313/346, 336, 337, 270, 313/341

[56] References Cited

U.S. PATENT DOCUMENTS

| | | | |
|---|---|---|---|
| 3,263,115 | 7/1966 | Glascock, Jr. et al. | 313/346 |
| 3,441,767 | 4/1969 | Kerstetter | 313/341 X |
| 3,450,927 | 6/1969 | Schmidt et al. | 313/337 X |
| 3,465,195 | 9/1969 | Fuchs | 313/337 X |
| 3,541,382 | 11/1970 | Takanashi et al. | 313/341 |
| 3,758,808 | 9/1973 | Held et al. | 313/346 |
| 3,881,124 | 5/1975 | Buescher et al. | 313/37 |
| 3,947,715 | 3/1976 | Puhak | 313/346 R |
| 3,983,443 | 9/1976 | Schade | 313/346 R |
| 4,129,801 | 12/1978 | Soeno et al. | 313/346 |
| 4,215,180 | 1/1979 | Misumi et al. | 428/553 |

*Primary Examiner*—Saxfield Chatmon, Jr.

[57] ABSTRACT

A one-piece, directly heated cathode is disclosed for use in a cathode ray tube electron gun. The cathode according to the invention has the configuration of a hollow cylinder with one closed end for receiving a thermionic electron-emissive coating. A pair of body portions extending axially in the same direction from diametrically opposed sides of the closed end define two legs which act as serial electrical conductors having inherent resistance for use in resistively heating the electron-emissive coating. The legs have an arcuate cross-section effective to structurally stabilize the cathode and suppress temperature-induced lateral displacement of the cathode which would otherwise degrade the performance of the electron gun.

3 Claims, 4 Drawing Figures

QUICK-HEATING CATHODE STRUCTURE

BACKGROUND OF THE INVENTION AND PRIOR ART DISCLOSURES

This invention relates to cathode ray tubes for image displays and is particularly concerned with improving the performance of electron guns used in such tubes.

The cathode of an electron gun used in a cathode ray tube relies upon thermionic emission for the release of electrons which are formed into a beam by the gun. Resistive heating of the cathode to provide a proper emission temprature requires a finite amount of time after a cathode ray tube device such as a television display is turned on, during which time the display is inoperative. The amount of time required among various brands and models may vary 6 to 20 seconds for conventional indirectly heated cathodes. These short periods can seem relatively long and annoying to a viewer. To shorten this warm-up period, television receivers, for example, have been equipped with means for applying a partial current to keep the cathode warm and ready for quick start-up when the apparatus is turned on. However, the urgent need to conserve energy has ruled out this "keep alive"0 approach. As a result, development efforts are being directed to instant-on, directly heated cathodes; that is, filamentary-type cathodes that have no keep-alive current drain, but nevertheless reach operating temperatures within one or two seconds.

The potential benefits are numerous. In addition to the obvious advantage of no standby current drain, the instant-on cathode operates with lower power consumption. The instant turn-on of the television picture is attractive to the user. In addition, instant turn-on is not only desirable but necessary in certain display applications wherein imaged data must be quickly available, such as in an aircraft cockpit or on an automotive panel display.

Cathodes normally comprise two basic members—a supporting structure, and a deposited material which becomes electron-emissive when heated to a temperature in the range of 800–900 degrees centigrade. In conventional cathode structures, the electron-emissive material is heated to emission temperature by a separate, electrically isolated heating element. In cathodes of the quick-heating type, heating may be accomplished by routing current through the supporting structure itself, which offers the necessary electrical resistance to the passage of current to produce the proper operating temperature.

The following design criteria are preferred objectives for cathodes of the quick-heating type.

1. Low mass. Heat capacity must be small for quick heating, as any significant structural mass necessarily slows the heating of the cathode to the desired thermal equilibrium wherein a satisfactory flow of electrons will be emitted.

2. Physical stability. Any appreciable lateral displacement of the cathode structure upon heating can degrade electron gun performance. The displacement is manifested as a distortion in the beam spot projected by the gun which becomes other than round. Similarly, translation of the cathode in the longitudinal direction can affect the critical spacing between the cathode and the adjacent first grid; this can also result in beam spot distortion. The spacing must typically be held to within ± 0.0001 inch.

Some longitudinal translation is inevitable upon heating; however, it must be predictable. When the cathode is heated to its normal operating temperature, the excursion limit of any longitudinal translation must be repeatable to maintain the required cathode-G1 spacing.

3. Immunity to shock and vibration. This factor is especially important where cathode ray tubes are used in vehicles. Movement of the cathode in response to vibration can be very noticeable in the image display. Shock can result in permanent displacement of the cathode from its proper location, especially when it is in a heated and relatively plastic state and hence more vulnerable to shock.

4. Proper resistance. In addition to providing physical stability, practical values of heating current require a material having a high electrical resistance (greater than 100 microhm—cm).

5. Hot strength. Adequate hot strength at operating temperatures of 850 degrees centrigrade, for example, is a specific requirement for any filamentary-type cathode substrate alloy, apart from subtleties of trace elememt cathode activators.

6. Low power consumption. The desired average power consumption is in the range of 600 to 1000 milliwatts.

7. Long life potential. Operating characteristics must not change appreciably as a result of many thousands of on-off cylings, nor must there be any premature burnout of the cathode.

8. Material compatability. The material of which the cathode structure is comprised, and the material of the electron-emissive deposit, must have nearly equivalent coefficients of expansion so that flaking and peeling of the deposit will not occur during repeated on-off cycling.

9. Environmental compatability. Cathodes must be capable of operation in the high-vacuum environment of the cathode ray tube without outgassing or releasing particulate matter.

10. Economical manufacture. Simplicity in structural design lowers manufacturing costs and helps ensure that all cathodes manufactured will operate in an identical manner.

U.S. Pat. No. 4,129,801 to Soeno et al, discloses a directly heated cathode comprising a cathode substrate body having two leg pieces extending in the same direction and including a flat part connected to one end of each leg piece. The body is prepared by shaping the flat metal plate of nickel or cobalt-based alloy, with a bonding layer applied having an uneven surface prepared by diffusion bonding by heating a powdered layer comprising powders of alloy or a mixture of nickel and cobalt formed on the flat part. A thermionic electron-emissivve layer is bonded to the flat part. An object of the invention is to provide a directly heated cathode free from thermal deformation.

Misumi et al, in U.S. Pat. No. 4,215,180, is addressed to oxide-coated cathodes containing as a base metal an alloy comprising at least one high-melting point metal. The object is to provide oxide-coated cathodes able to prevent an interfacial reaction between the alkaline earth oxides and the base metal plate which can result in peeling of the oxides from the base. The cathode structure upon which the invention is practiced is indicated as being a bare metal plate supported by two outwardly angled pillars resting on terminals connected to power source.

A direct heated cathode member for an electron tube is disclosed by Takanashi et al, in U.S. Pat. No. 3,541,382. A ribbon-shaped heater is stretched over an insulating substrate with its major surface very close to and parallel to that of the substrate. The ends of the ribbon-shaped heater are fitted to elastic metal strips so the heater is kept tensioned in parallel relation to the substrate, and a layer of thermion-emittilng material is deposited on the central part of the heater.

A three-piece, fast warm-up picture tube cathode system is disclosed by Buescher et al, in U.S. Pat. No. 3,881,124. A discrete cathode cap is supported by a separate structure which includes a plurality of relatively thin tabs attached to the cap. The number of such tabs is specified by Buescher et al, as being ". . . four in number (three tabs have been tried and are satisfactory) . . ." the use of such thin tabs is said to provide for poor heat conduction between the cap and the supporting structure necessary for fast warm-up. The third member is a heater filament located within the cap for heating the cap to the proper cathode emission temperature. Warm-up time is stated to be between five and six seconds.

OBJECTS OF THE INVENTION

It is a general object of this invention to improve the performance characteristics of quick-heatng cathodes used in cathode ray tube electron guns.

It is another general object to provide a cathode structure able to acheive full electron emission in about 1 second.

It is a less general object to provide a quick-heating cathode structure able to maintain proper cathode-to-grid spacing when heated to emission temperature.

It is a more specific object of the invention to provide a quick-heating cathode structure immune to lateral displacement upon heating, and immune to shock and vibration.

It is a specific object of the invention to provide a quick-heating cathode structure that lends itself to economical manufacture.

It is another specific object of the invention to provide a quick-heating cathode structure having a relatively low power consumption.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings in which:

DESCRIPTION OF THE PREFERRED EMBODIMENT

Figure 1:
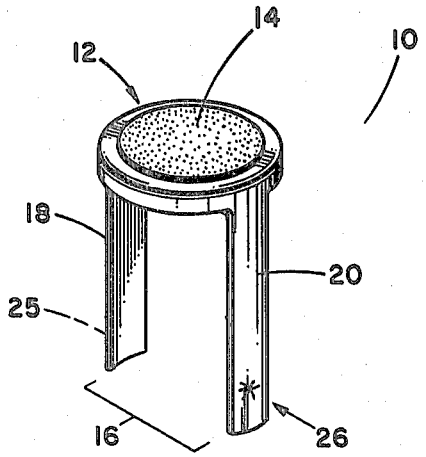
FIG. 1 is an elevational view in perspective of a preferred embodiment of a quick-heating cathode according to the invention.
Figure 2:
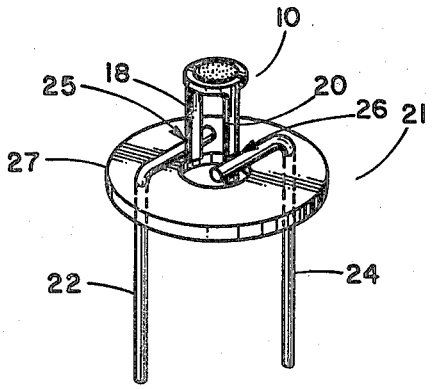
FIG. 2 is a view in elevation and in perspective indicating means for mounting the cathode according to the invention; and, FIG. 3 is an elevational, schematic view of a means manufacturing the cathode according to the invention.

A one-piece, directly heated cathode 10 according to the invention for use in a cathode ray tube electron gun is shown by FIGS. 1 and 2. Cathode 10 has the configuration of a hollow cylinder with one closed end 12 for receiving a thermionic electron-emissive coating 14.

A pair of body portions 16, indicated by the bracket, extend axially in the same directon from diametrically opposed sides of closed end 12. Body portions 16 define two legs 18 and 20 effective to structurally stabilize cathode 10 according to the invention and suppress temperature-induced lateral displacement of cathode 10 which would otherwise degrade the performance of the electron gun.

The body material of which cathode 10 is preferably comprised is designated as Hastelloy ® alloy B-2 manufactured by the Stellite division of Cabot Corporation, Kokomo, Indiana. Alloy B-2 is a nickel-based alloy specified by Cabot Corporation as having the following composition, by percent:

cobalt, 1.00*
chromium, 1.00*
molybdenum, 26–30
iron, 2.00*
silicon, 0.10*
manganese, 1.00*
carbon, 0.02*
phosphorus, 0.040*
sulphur, 0.030*

(the asterisk * denotes maximum)

The composition of the electron-emissive material 14 may comprise the following ingredients in the percentages specified. The material is compounded in the form of a slurry having a liquidity property suitable for application by spray gun means.

| | | |
|---|---|---|
| (a) | carbonates, | 42 |
| (b) | butyl acetate, | 19.5 |
| (c) | binder solution | 38.5 |
| | TOTAL | 100.0% |
| The carbonates (a) may comprise: | | |
| | barium carbonate | 57 ± 2 |
| | strontium carbonate | 39 ± 2 |
| | calcium carbonate | 40 ± 4 |
| | TOTAL | 100.0% |

The binder solution (c) may be comprised of a mixture of butyl acetate, butyl cellusolve, and nitrocellulose. A suitable binder solution known to those skilled in the art is supplied by RCA, Lancaster, PA.

A cathode mounting means 21 for mounting cathode 10 for operation is depicted in FIG. 2. Two L-shaped electrical leads 22 and 24 are indicated as passing through perforations in a disc 27, which may comprise a ceramic. Leads 22 and 24 can be attached to disc 27 by a glazing operation, or by metallizing and brazing, for example. The overall length of each lead 22 and 24 is 0.50 inch. Legs 18 and 20 of cathode 10 are shown as being attached to leads 22 and 24; the attachement may be by welding at weld points 25 and 26, as depicted. The material of leads 22 and 24 may comprise Kovar ® wire 0.019 inch in diameter, by way of example. Disk 27 may be 0.330 inch in diameter and having thickness of 0.031 inch. Electrical leads 22 and 24 can be attached by welding each to one of the lead-in pins (not shown)

entering the cathode ray tube stem for the serial passage of electrical current to provide operating current to cathode 10. The current required is about 0.920 ampere, and the operating temperature of cathode 10 according to the invention is about 840 degrees centigrade. The electrical resistance of cathode 10 according to the invention to the serial passage of electrical current is about 0.650 ohm when cold, and substantially the same when at the desired electron-emission temperature; that is, 840 degrees centigrade.

The dimensions in inches of the preferred embodiment of the cathode 10 according to the invention are about as follows:

diameter of closed end 12, 0.054
overall length of cathode 10, 0.140
width of each leg 18 and 20, 0.026
thickness of the material, 0.001

It is to be noted that these and other dimensions and values set forth herein are by way of example only, and are in no way limiting.

Figure 1A:
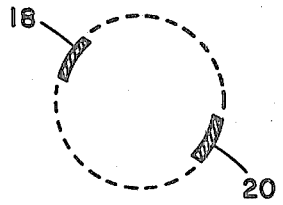
FIG. 1A is a sectional plan view of a supportive member showing a detail of the cathode depicted by FIG. 1.
Figure 3:
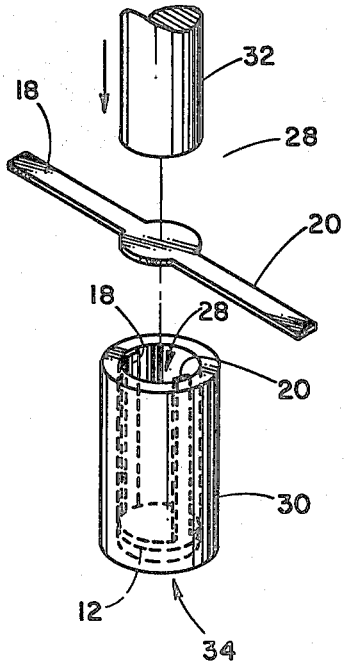

The simple configuration of cathode 10, and the use of a ductile, easily formed alloy, ensures easy, low-cost manufacture by metal-forming techniques well-known to those skilled in the art. An example is shown by FIG. 3 wherein a means for forming the cathode in mass-production is depicted schematically. A blank 28 of the alloy specified having a bow-tie shape, with legs 18 to 20 as indicated, is formed by well-known die-cutting and shaping means. A cylindrical forming member 30, essentially a hollow cylinder, provides for receiving and forming blank 28 as cylindrical punch 32 moves downwardly, as indicated by the associated arrow, to enter member 30. A blank 28 is shown by dash lines as having been formed by the die set to provide legs 18 and 20 of the arcuate cross-section depicted by FIG. 1A. Blank 28 can be stripped from cylindrical forming member 30 through the bottom aperture 34 by the withdrawal of punch 32.

The structure then receives the electron-emissive coating 14 by means such as spraying. The cathode 10 is mounted on cathode mounting means 21 by attaching legs 18 and 20 to electrical leads 22 and 24 at points 24 and 25 by means such as welding.

The cathode according to the invention provides a warm-up time of about 1.0 second. The arcuate cross-section of the legs is effective to structurally stabilize the cathode and suppress temperature-induced lateral displacement of the cathode. The arcuate cross-section is also effective to provide immunity to shock and vibration. Cathodes according to the invention have a proven operating life exceeding 4,000 hours under frequent on-off cycling (4 cycles per hour), and a predicted life several times longer. The cathodes can operate in the high-vacuum environment of the cathode ray tube without out-gassing or the releasing of particulate matter.

The cathode according to the invention as fabricated from the alloy specified, is highly resistant to burn-out. For example, the potential across a cathode under test was raised to 1.106 VDC, producing cathode temperature of 1285 degrees centigrade, at which level burn-out occurred.

While a particular embodiment of the invention has been shown and described, it will be obvious to those skilled in the art that changes and modifications may be made without departing from the invention in its broader aspects, and therefore, the aim of the appended claims is to cover all such changes and modifications as falling within the true spirit and scope of the invention.

I claim:

1. For use in a cathode ray tube electron gun, a one-piece directly heated cathode comprising:

a thermionic electron-emissive coating; and a support structure for said coating comprising a portion of an open-ended hollow cylindrical body having a closed end for receiving and supporting said coating, said closed end having an integral pair of body sections extending axially in the same direction from diametrically opposed sides of said closed end to define two parallel legs that constitute, in conjuncton with said closed end, an electrically conductive path that exhibits an inherent resistance to an electrical current to generate heat for transfer to said coating, said legs having an arcuate cross-section effective to structurally stabilize said cathode and suppress temperature-induced lateral displacement of the support structure which would otherwise degrade performance of said electron gun.

2. A one-piece, directly heated cathode as set forth in claim 1 in which said support structure is formed from Hastelloy® alloy B-2 about 0.001 inch thick and has an axial length of about 0.140 inch, said closed end has a diameter of about 0.054 inch, and said two legs have a width of about 0.026 inch.

3. The cathode as defined by claim 1 wherein said inherent resistance is a resistance of about 0.650 ohm when said cathode is cold, and substantially the same when said cathode is at the desired electron-emission temperature.

* * * * *